US007824234B2

(12) United States Patent
Kamata et al.

(10) Patent No.: US 7,824,234 B2
(45) Date of Patent: Nov. 2, 2010

(54) CONNECTOR IN WHICH CONTACTS ARE HELD BY A HOUSING INCLUDING FIRST AND SECOND HOUSING MEMBERS, AND IN WHICH A RETAINING PORTION OF THE CONTACTS ABUTS THE SECOND HOUSING MEMBER WHEN THE HOUSING MEMBERS ARE ASSEMBLED

(75) Inventors: Kazushi Kamata, Tokyo (JP); Kenichi Kotaka, Tokyo (JP); Kan Ozawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/418,753

(22) Filed: Apr. 6, 2009

(65) Prior Publication Data

US 2009/0258529 A1 Oct. 15, 2009

(30) Foreign Application Priority Data

Apr. 14, 2008 (JP) ..... 2008-104741

(51) Int. Cl.
*H01R 13/514* (2006.01)

(52) U.S. Cl. ..... 439/752; 439/660

(58) Field of Classification Search ..... 439/752, 439/660, 712, 713, 444, 733.1, 367
See application file for complete search history.

(56) References Cited

U.S. PATENT DOCUMENTS 6,106,338 A * 8/2000 Wu et al. ..... 439/660
6,755,693 B2 * 6/2004 Nishio et al. ..... 439/660
6,955,568 B1 * 10/2005 Wu ..... 439/660
7,465,194 B1 * 12/2008 Ho et al. ..... 439/607.01

FOREIGN PATENT DOCUMENTS

JP 2005-135794 A 5/2005

* cited by examiner

*Primary Examiner*—Michael C Zarroli
(74) *Attorney, Agent, or Firm*—Holtz, Holtz, Goodman & Chick, PC

(57) ABSTRACT

A connector which makes it possible to prevent contacts from being removed without increasing press-in force of the contacts. A crank-shaped portion or protruding portion is formed, as a retaining portion, on an linking portion which links a contact portion and a connection portion of each contact. A housing for holding a plurality of the contacts is comprised of a front housing in which contact-side portions of the contacts are disposed, and a rear housing in which connection-side portions of the same are disposed. When the front housing and the rear housing are assembled, the crank-shaped portion and the protruding portions are brought into abutment with the rear housing.

7 Claims, 19 Drawing Sheets

CONNECTOR IN WHICH CONTACTS ARE HELD BY A HOUSING INCLUDING FIRST AND SECOND HOUSING MEMBERS, AND IN WHICH A RETAINING PORTION OF THE CONTACTS ABUTS THE SECOND HOUSING MEMBER WHEN THE HOUSING MEMBERS ARE ASSEMBLED

BACKGROUND OF THE INVENTION

1. Field of the Invention

This invention relates to a connector.

2. Description of the Related Art

Conventionally, there has been proposed a connector comprised of a connector housing and a plurality of press-fitting terminals (see Japanese Laid-Open Patent Publication (Kokai) No. 2005-135794).

The connector housing has a plurality of terminal press-fitting holes formed therein.

Each of the press-fitting terminals has a long narrow plate-like shape, and is formed by blanking a metal plate. Each press-fitting terminal has a front end formed with a contact portion, a rear end formed with a connection portion, and an intermediate portion formed with a fixing portion. The fixing portion is formed with a plurality of retaining protrusions.

When the press-fitting terminals are inserted in the terminal press-fitting holes of the connector housing, each retaining protrusion of the fixing portion bite into an inner periphery surface of each terminal press-fitting hole, whereby the press-fitting terminals are fixed to the connector housing.

In the above-described connector, although the press-fitting terminals are fixed to the connector housing by press-fitting the press-fitting terminals in the terminal press-fitting holes of the connector housing, if the press-fitting terminals are pulled, there is a fear that the press-fitting terminals are removed from the terminal press-fitting holes of the connector housing. To prevent the press-fitting terminals from being removed, it is only necessary to increase press-in force of the retaining protrusions, however if the press-in force is increased, although the fixing strength of the press-fitting terminals is ensured, it becomes difficult to perform a press-fitting operation of the press-fitting terminals, and at the same time there is a fear that the press-fitting terminals are deformed (buckling or the like).

SUMMARY OF THE INVENTION

The present invention has been made in view of these circumstances, and an object thereof is to provide a connector which makes it possible to prevent contacts from being removed without increasing the press-in force of the contacts.

To attain the above object, the present invention provides a connector comprising a plurality of contacts that each have a contact portion which is brought into contact with one object to be connected, a connection portion which is connected to the other object to be connected, a linking portion which links the contact portion and the connection portion and is formed with a retaining portion, and a press-fitting portion, and a housing that holds the plurality of contacts by having the press-fitting portion press-fitted therein, the housing including a first housing member in which contact-side portions of the contacts are disposed, and a second housing member which is assembled with the first housing member and in which connection-side portions of the contacts are disposed, the retaining portion being brought into abutment with the second housing member when the first and second housing members are assembled.

With the arrangement of the connector according to the present invention, when the first and second housing members are assembled, the retaining portion of the linking portion of each contact is brought into abutment with the second housing member. Therefore, when the contacts are pulled, the contacts are difficult to be removed from the housing.

Preferably, the retaining portion is a crank-shaped portion which is formed by bending the linking portion of the contact into a crank shape.

Preferably, the retaining portions is a protruding portion which is formed on the linking portion of the contact in a manner protruding in a width direction thereof.

Preferably, the retaining portion of each of some of the plurality of contacts is a crank-shaped portion which is formed by bending the linking portion of the contact into a crank shape, and wherein the retaining portions of each of a remainder of the plurality of contacts is a protruding portion which is formed on the linking portion of the contact in a manner protruding in a width direction thereof.

Preferably, the first housing member is formed with first locking portions, and the second housing member is formed with second locking portions which are engaged with the first locking portions to thereby connect the second housing member to the first housing member.

According to this invention, it is possible to prevent the contacts from being removed without increasing press-in force of the contacts.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
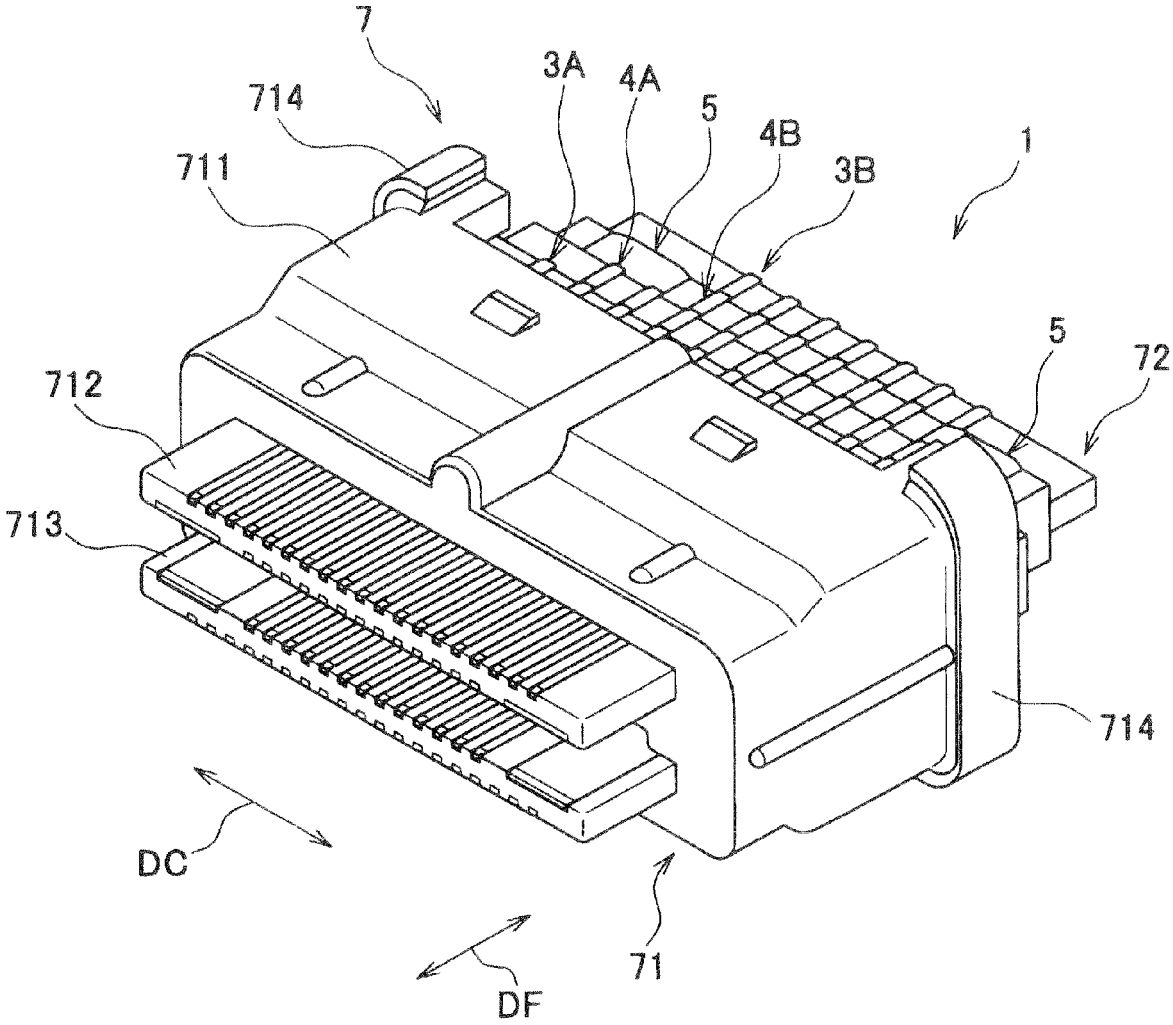
FIG. 1 is a perspective view of a connector according to an embodiment of the present invention as taken obliquely from the front.
Figure 2:
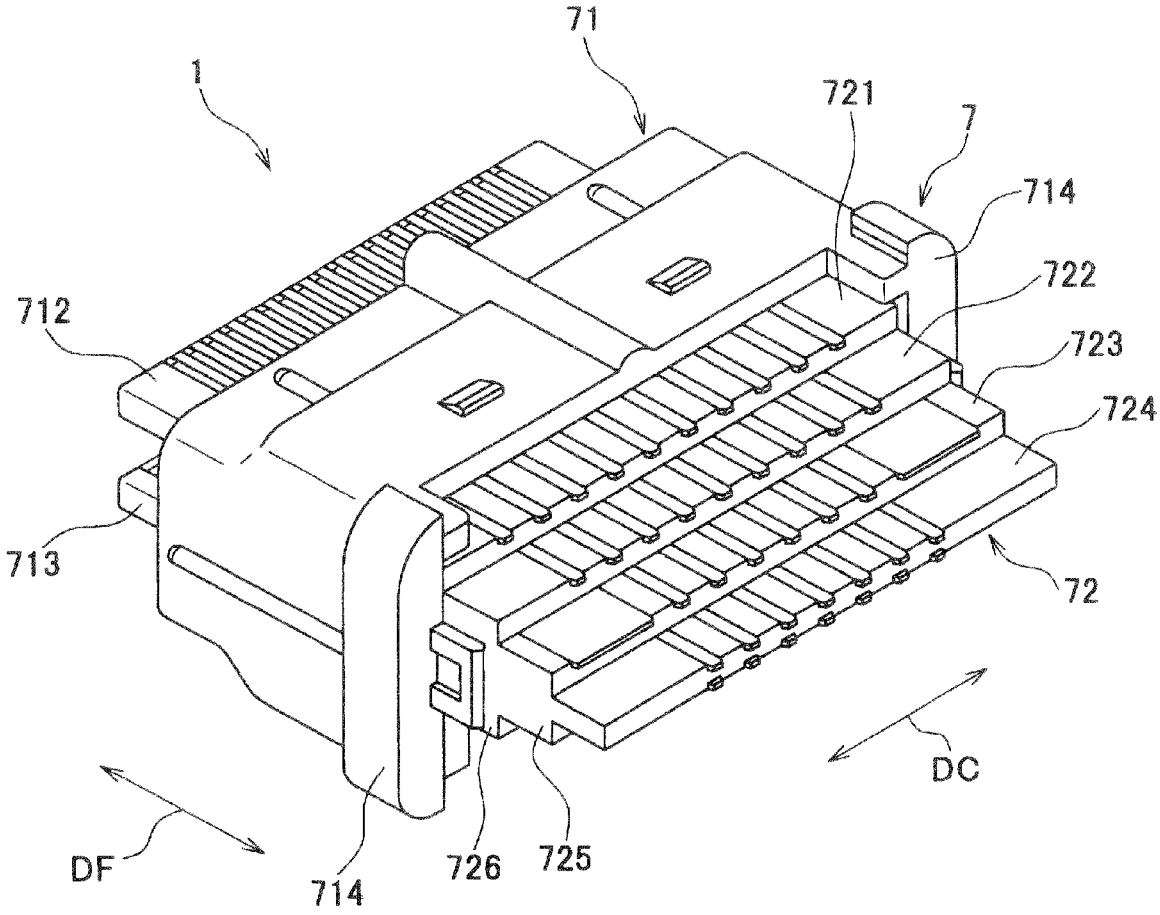
FIG. 2 is a perspective view of the connector shown in FIG. 1 as taken obliquely from the rear.

As shown in FIGS. 1 and 2, a connector 1 is comprised of a plurality of first contacts 3A, a plurality of second contacts 3B, a plurality of third contacts 4A, a plurality of fourth contacts 4B, a plurality of contacts 5 for power supply, and a housing 7.

Figure 3:
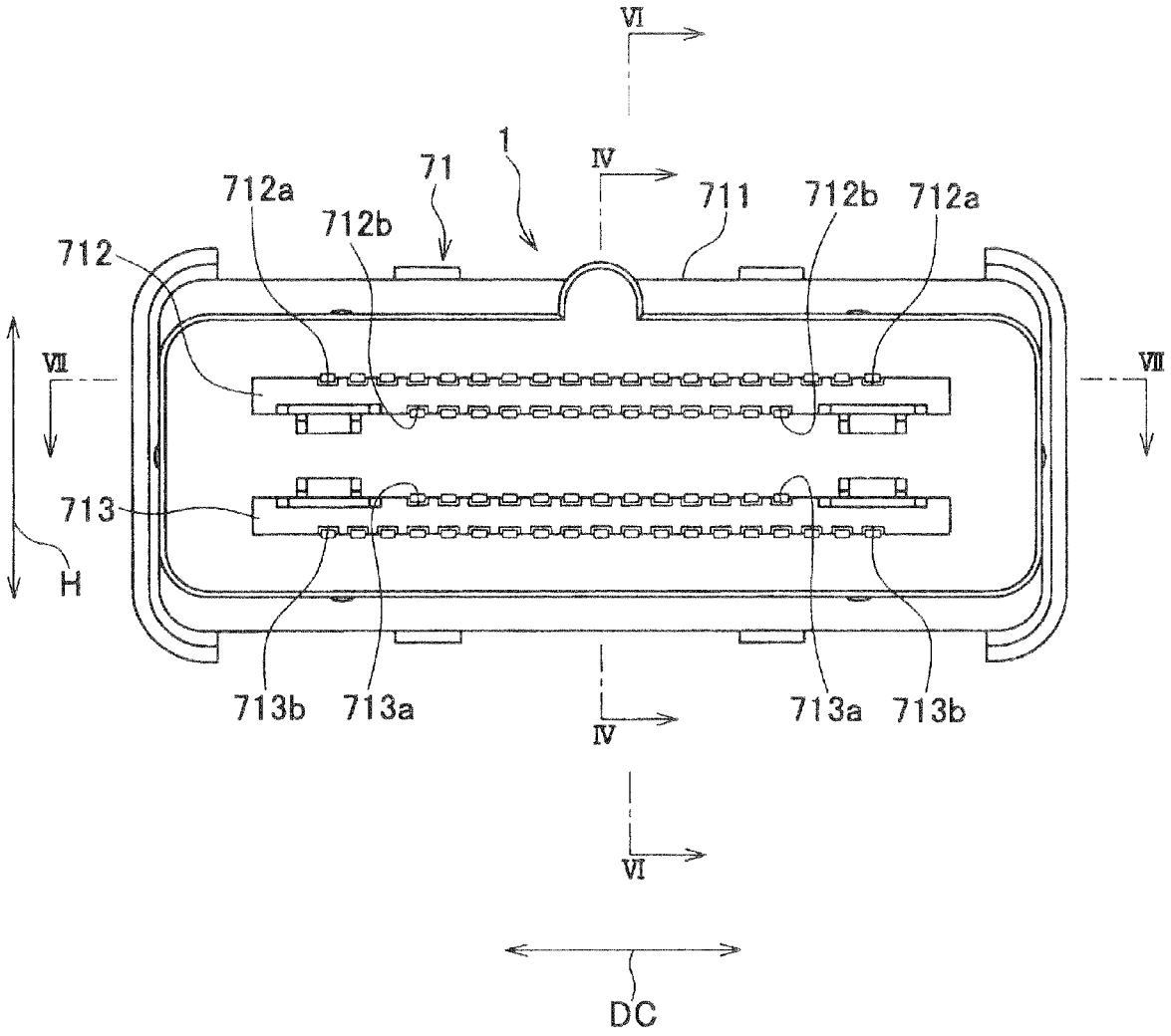
FIG. 3 is a front view of the connector shown in FIG. 1.
Figure 6:
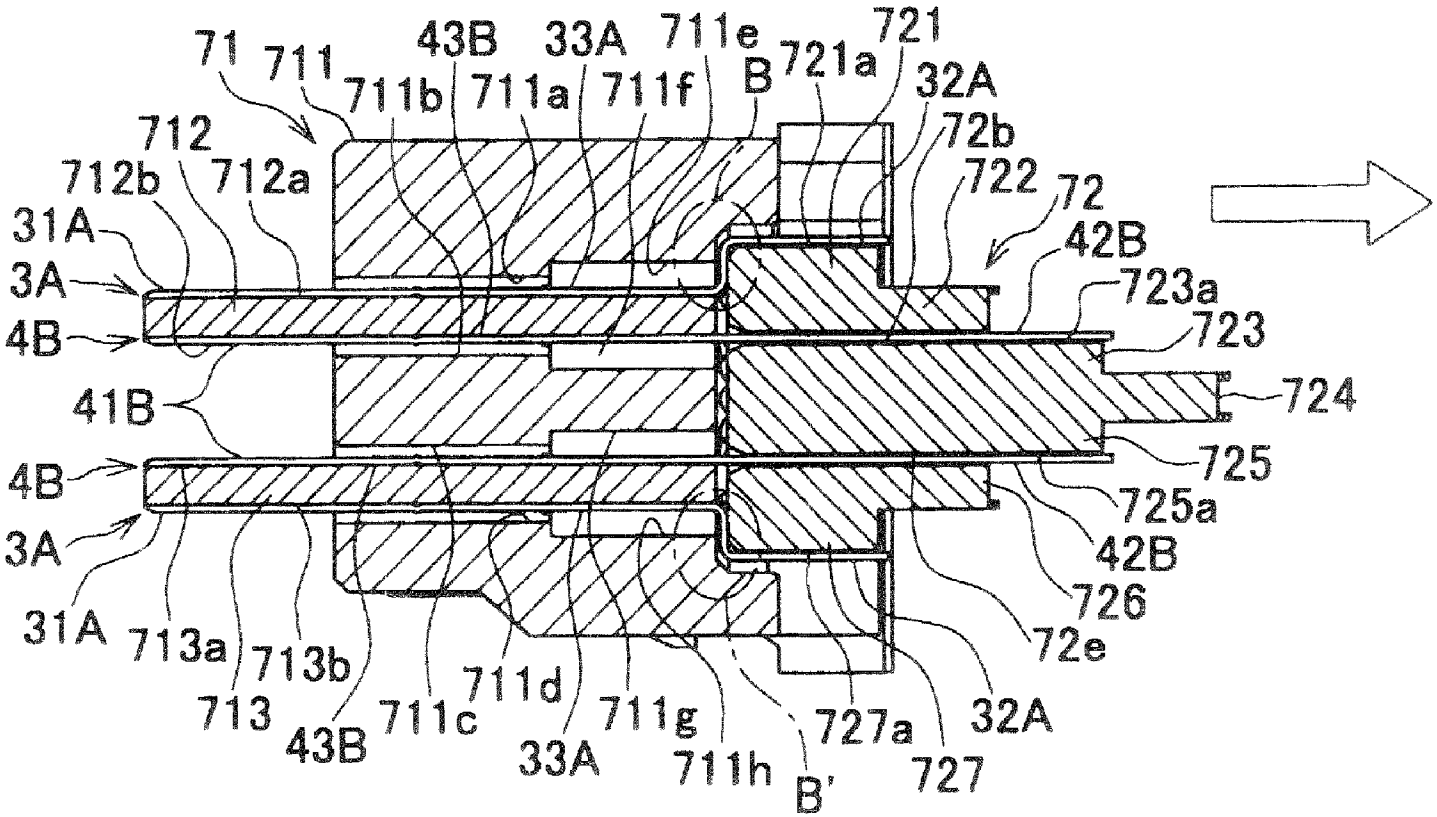
FIG. 6 is a cross-sectional view taken on line VI-VI in FIG. 3.
Figure 7:
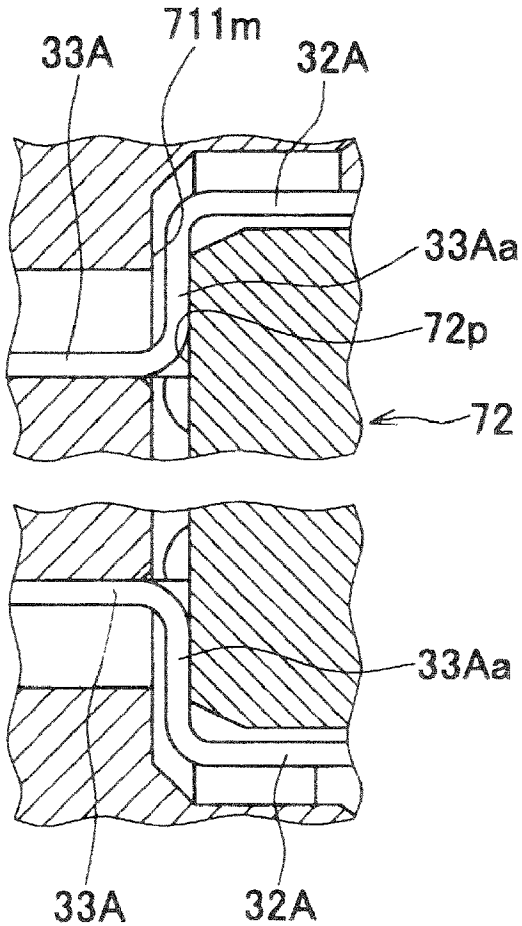
FIG. 7 is an enlarged view of parts B and B' in FIG. 6.
Figure 10:
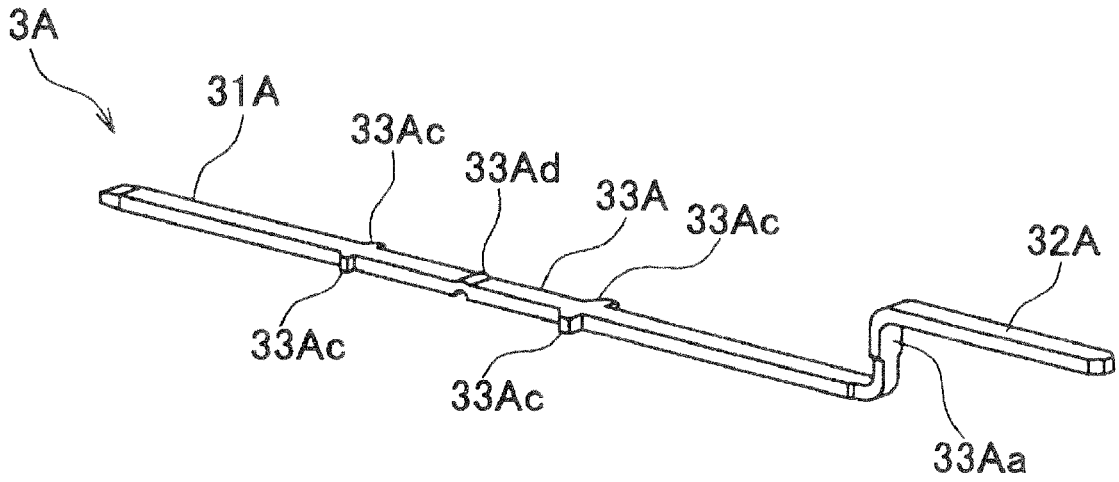
FIG. 10 is a perspective view of a first contact of the connector shown in FIG. 1.

As shown in FIGS. 6, 7, and 10, each of the first contacts 3A includes a contact portion 31A, a connection portion 32A, and a linking portion 33A. The contact portion 31A is brought into contact with an associated contact of a mating connector (one object to be connected), not shown. The contact portion 31A is accommodated in a holding groove 712*a* or 713*b*, referred to hereinafter, and is held in a front housing 71. The connection portions 32A are connected to an electronic device or the like, not shown, via a cable (the other object to be connected), not shown. The cable is soldered to the connection portions 32A. Each connection portion 32A is accommodated in a holding groove 721*a* or 727*a*, referred to hereinafter, and is held in a rear housing 72. The linking portion 33A links i.e. connects between the associated contact portion 31A and connection portion 32A. The linking portion 33A is inserted through an associated one of insertion holes 711*a* or 711*d*, referred to hereinafter. The linking portion 33A is formed with a crank-shaped portion (retaining portion) 33Aa which is formed by bending the linking portion 33A into a crank shape. The crank-shaped portions 33Aa are brought into abutment with a front 72*p* of the rear housing 72, referred to hereinafter. This makes it possible to prevent the first contacts 3A from being removed from the housing 7. Further, the linking portion 33A is formed with four protruding pieces (press-fitting portions) 33Ac and a protuberance 33Ad. The protruding pieces 33Ac are press-fitted in the associated insertion hole 711*a* or 711*d*. As a result, the first contacts 3A are fixed to the front housing 71. The protuberance 33Ad is formed to prevent the linking portion 33A from wobbling in a direction H (see FIG. 3) of the height of the housing 7 when the linking portion 33A is inserted through the associated insertion hole 711*a* or 711*d*.

Figure 4:
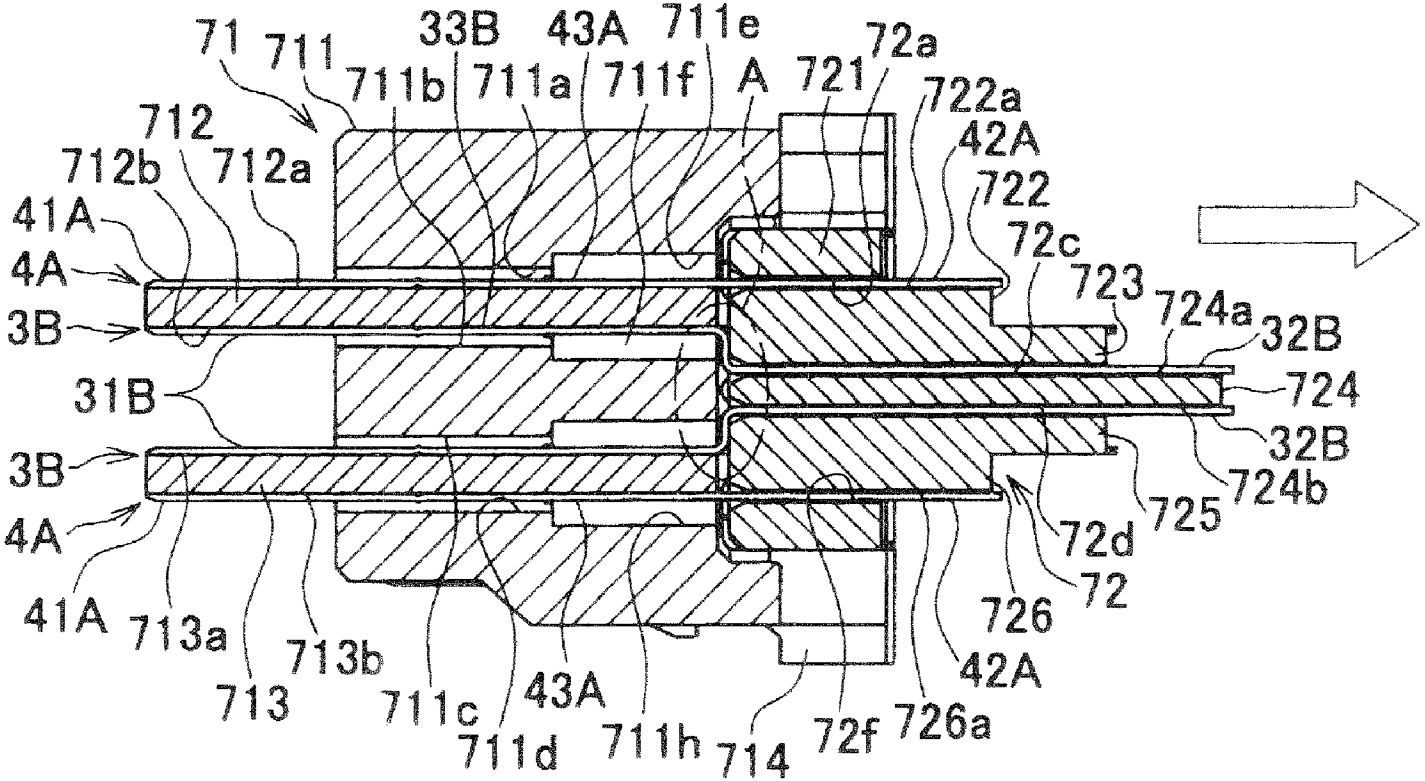
FIG. 4 is a cross-sectional view taken on line IV-IV of FIG. 3.
Figure 5:
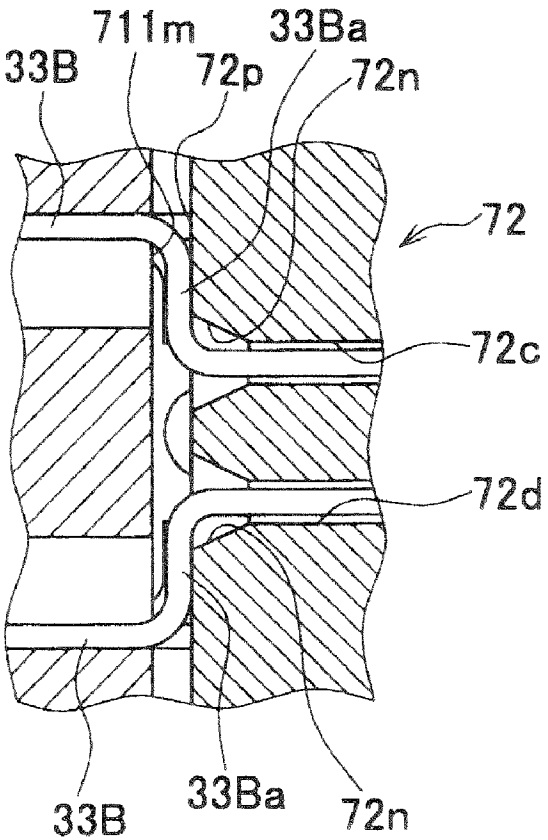
FIG. 5 is an enlarged view of part A in FIG. 4.
Figure 11:
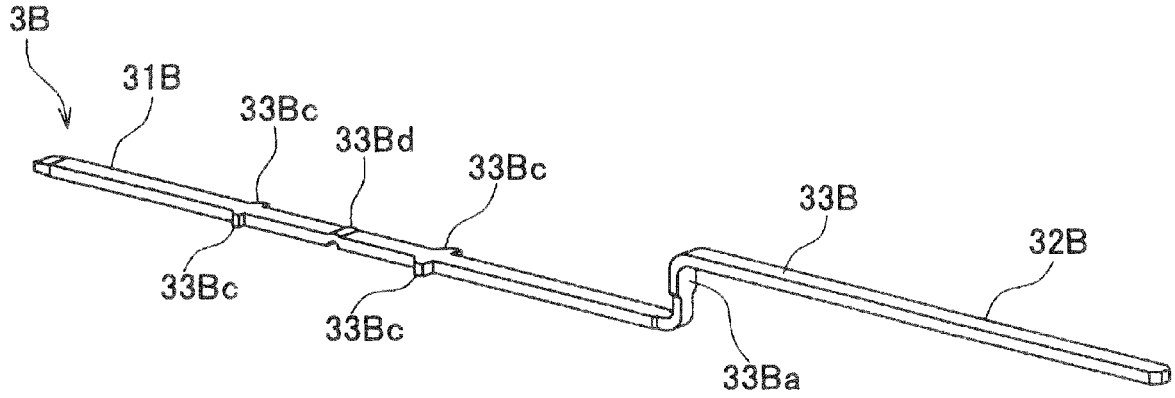
FIG. 11 is a perspective view of a second contact of the connector shown in FIG. 1.

As shown in FIGS. 4, 5, and 11, each of the second contacts 3B includes a contact portion 31B, a connection portion 32B, and a linking portion 33B. The contact portion 31B is brought into contact with an associated contact of the mating connector. The contact portion 31B is held in an associated one of holding grooves 712*b* or 713*a*, referred to hereinafter. The connection portions 32B are connected to the electronic device or the like via the cable (the other object to be connected). The cable is soldered to the connection portions 32B. Each connection portion 32B is held in an associated one of holding grooves 724*a* or 724*b*, referred to hereinafter. The linking portion 33B links i.e. connects between the associated contact portion 31B and connection portion 32B. The linking portion 33B is inserted through associated ones of insertion holes 711*b* and 72*c* or 711*c* and 72*d*, referred to hereinafter. Each linking portion 33B is formed with a crank-shaped portion (retaining portion) 33Ba which is formed by bending the linking portion 33B into a crank shape. The crank-shaped portions 33Ba are brought into abutment with the front 72*p* of the rear housing 72. This makes it possible to prevent the second contacts 3B from being removed from the housing 7. Further, each linking portion 33B is formed with four protruding pieces (press-fitting portions) 33Bc and a protuberance 33Bd. The protruding pieces 33Bc are press-fitted in the associated insertion hole 711*b* or 711*c*. As a result, the second contact 3B is fixed to the front housing 71. The protuberance 33Bd is formed to prevent the linking portion 33B from wobbling in the direction H (see FIG. 3) of the height of the housing 7 when the linking portion 33B is inserted through the associated insertion hole 711*b* or 711*c*.

Figure 8:
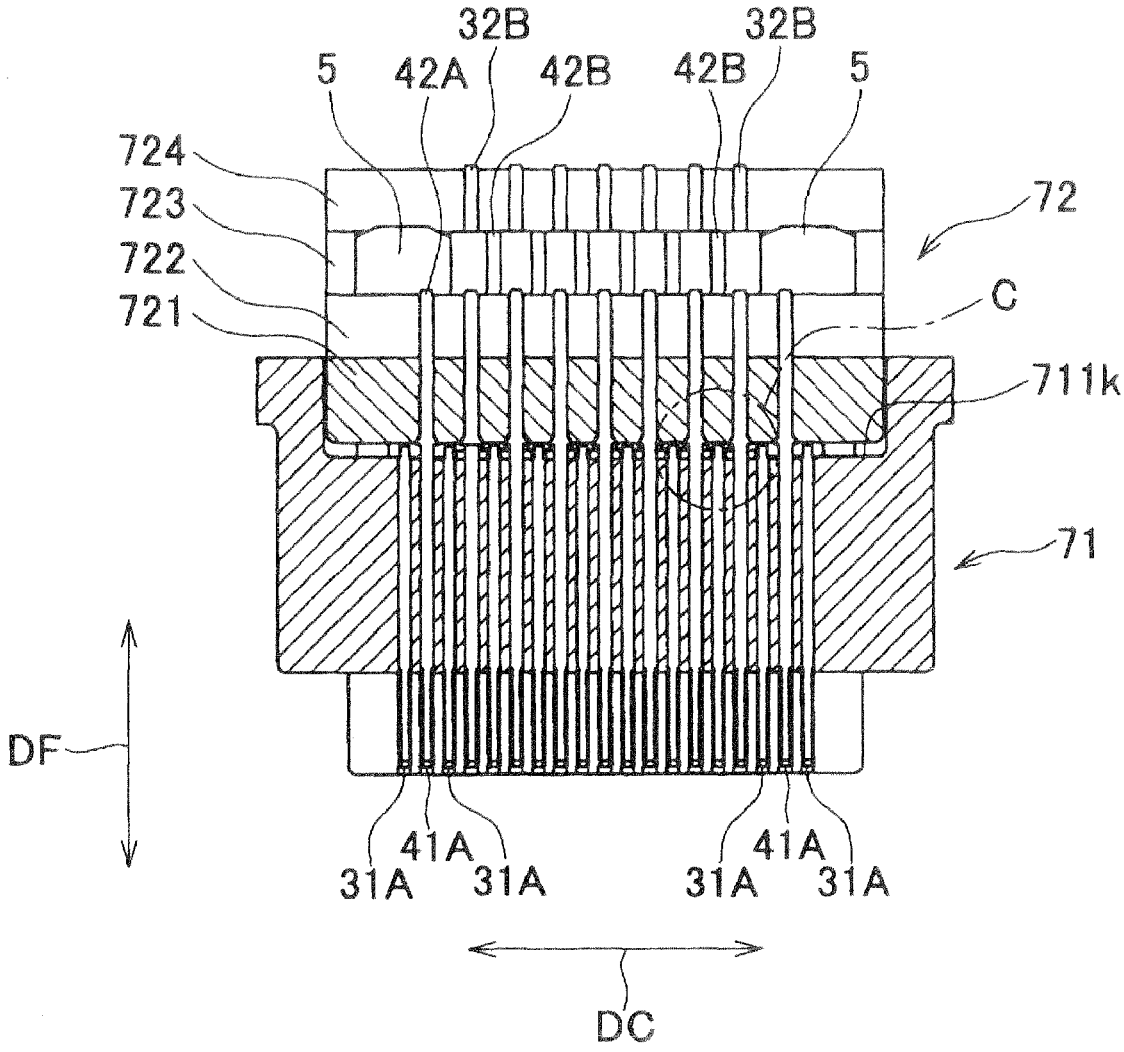
FIG. 8 is a cross-sectional view taken on line VIII-VIII in FIG. 3.

Although the contact 3A and the contact 3B are similarly constructed, different points are as follows: The linking portion 33B is longer than the linking portion 33A. Although the crank-shaped portion 33Aa is located at an end of the linking portion 33A toward the connection portion, the crank-shaped portion 33Ba is located at an intermediate part of the linking portion 33B. However, the crank-shaped portions 33Aa and 33Ba are disposed at the same positions with respect to the mating connector in a fitting/removing direction DF (see FIG. 8) of the connector 1.

Figure 12:
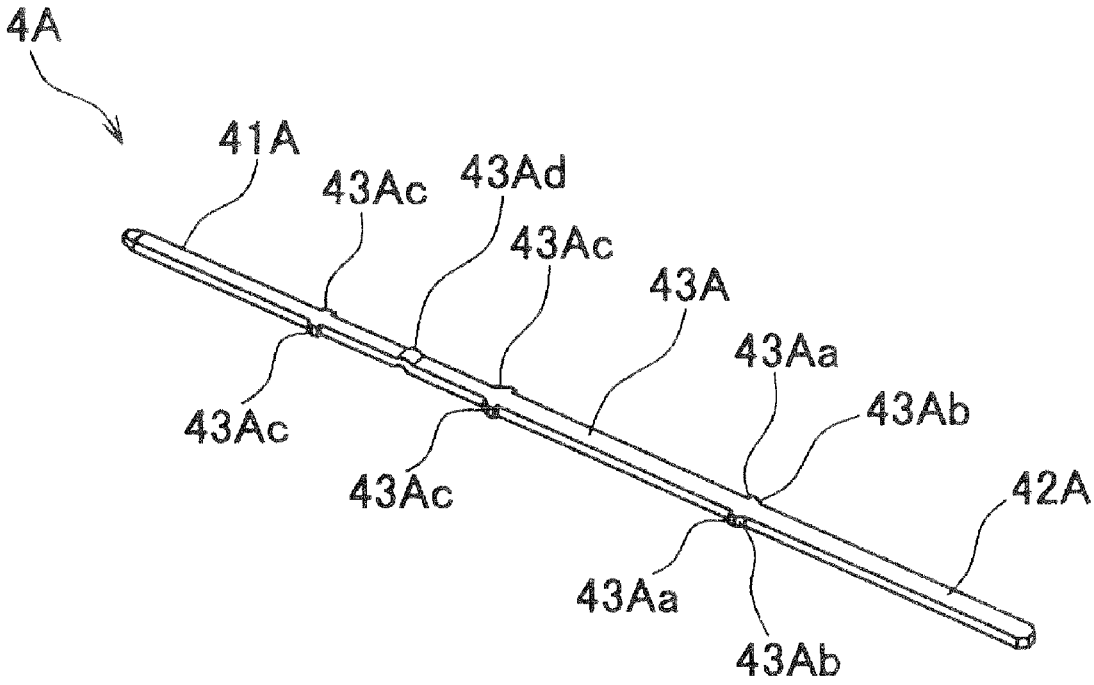
FIG. 12 is a perspective view of a third contact of the connector shown in FIG. 1.

As shown in FIGS. 4 and 12, each of the third contacts 4A includes a contact portion 41A, a connection portion 42A, and a linking portion 43A. The contact portion 41A is brought into contact with an associated contact of the mating connector The contact portion 41A is accommodated in the associated holding groove 712*a* or 713*b*, and is held in the front housing 71. The connection portion 42A is connected to the electronic device or the like via the cable (the other object to be connected). The cable is soldered to the connection portions 42A. Each connection portion 42A is accommodated in an associated one of holding grooves 722*a* or 726*a*, referred to hereinafter, and is held in the rear housing 72. The linking portion 43A links i.e. connects between the contact portion 41A and the connection portions 42A. The linking portion 43A is inserted through associated ones of the insertion holes 711*a* and insertion holes 72*a* or associated ones of the insertion holes 711*d* and insertion holes 72*f*. The linking portion 43A is formed with a pair of protruding portions (retaining portions) 43Aa. Each of the protruding portion 43Aa has an inclined surface 43Ab (see FIG. 9). The protruding portion 43Aa is brought into abutment with a guiding surface 72*n* of the rear housing 72. This makes it possible to prevent the third contacts 4A from being removed from the housing 7. Further, the linking portion 43A is formed with four protruding pieces (press-fitting portions) 43Ac and a protruding portion 43Ad. The protruding pieces 43Ac are press-fitted in the associated insertion hole 711*a* or 711*d*. As a result, the third contacts 4A are fixed to the front housing 71. The protruding portion 43Ad is formed to prevent the linking portion 43A from wobbling in the direction H (see FIG. 3) of the height of the housing 7 when the linking portion 43A is inserted through the associated insertion hole 711*a* or 711*d*.

Figure 13:
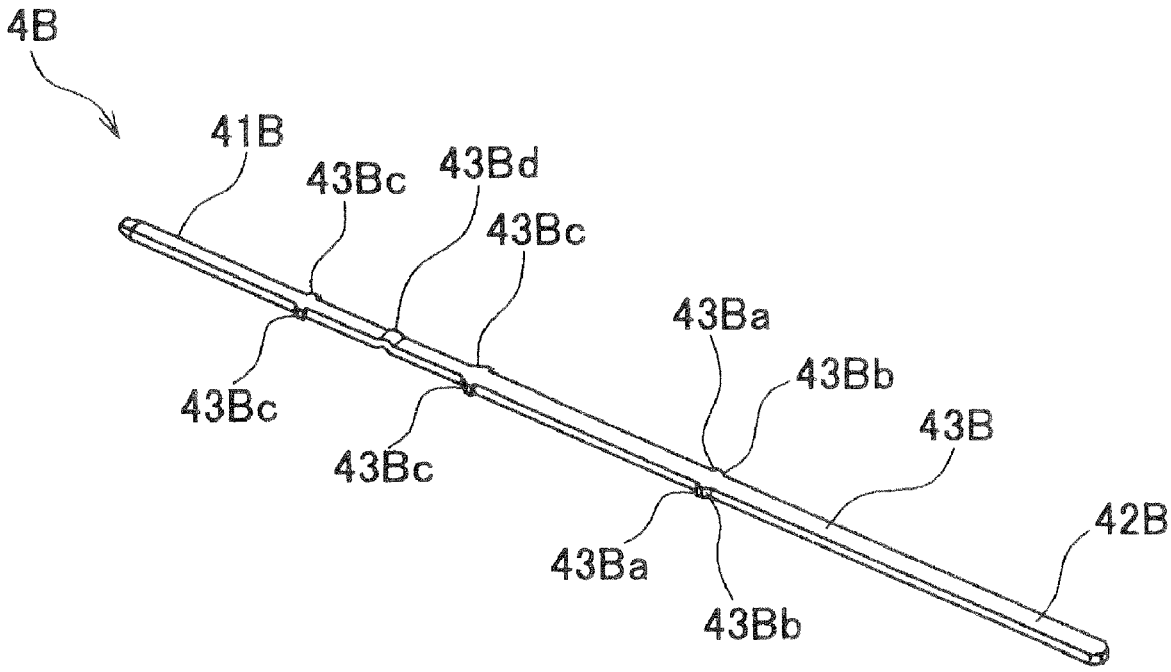
FIG. 13 is a perspective view of a fourth contact of the connector shown in FIG. 1.

As shown in FIGS. 6, and 13, each of the fourth contacts 4B includes a contact portion 41B, a connection portion 42B, and a linking portion 43B. Each contact portion 41B is brought into contact with an associated contact of the mating connector. The contact portion 41B is accommodated in the associated holding groove 712*b* or 713*a*, and is held in the front housing 71. The connection portion 42B is connected to the electronic device or the like via the cable (the other object to be connected). The cable is soldered to the connection portions 42B. Each connection portion 42B is accommodated in an associated one of holding grooves 723*a* or 725*a*, and is held in the rear housing 72. The linking portion 43B links i.e. connects between the associated contact portion 41B and connection portion 42B. The linking portion 43B is inserted through associated ones of the insertion holes 711*b* and insertion holes 72*b* or associated ones of the insertion holes 711*c* and insertion holes 72*e*. The linking portion 43B is formed with a pair of protruding portions (retaining portion) 43Ba. Each of the protruding portions 43Ba has an inclined surface 43Bb. The protruding portions 43Ba are brought into abutment with the associated guiding surfaces 72*n* (see FIG.9) of the rear housing 72. This makes it possible to prevent the fourth contacts 4B from being removed from the housing 7. Further, the linking portion 43B is formed with four protruding pieces (press-fitting portions) 43Bc and a protruding portion 43Bd. The protruding pieces 43Bc are press-fitted in the associated insertion hole 711*b* or 711*c*. As a result, the fourth contacts 4B are fixed to the front housing 71. The protruding portion 43Bd is formed to prevent the linking portion 43B from wobbling in the direction H (see FIG. 3) of the height of the housing 7 when the linking portion 43B is inserted through the associated insertion hole 711*b* or 711*c*.

Although the contact 4A and the contact 4B are similarly constructed, different points are as follows; The linking portion 43B is longer than the linking portion 43A. However, the protruding portions 43Aa and 43Ba are disposed at the same positions with respect to the mating connector in the fitting/removing direction DF (see FIG. 8) of the connector 1.

Figure 18:
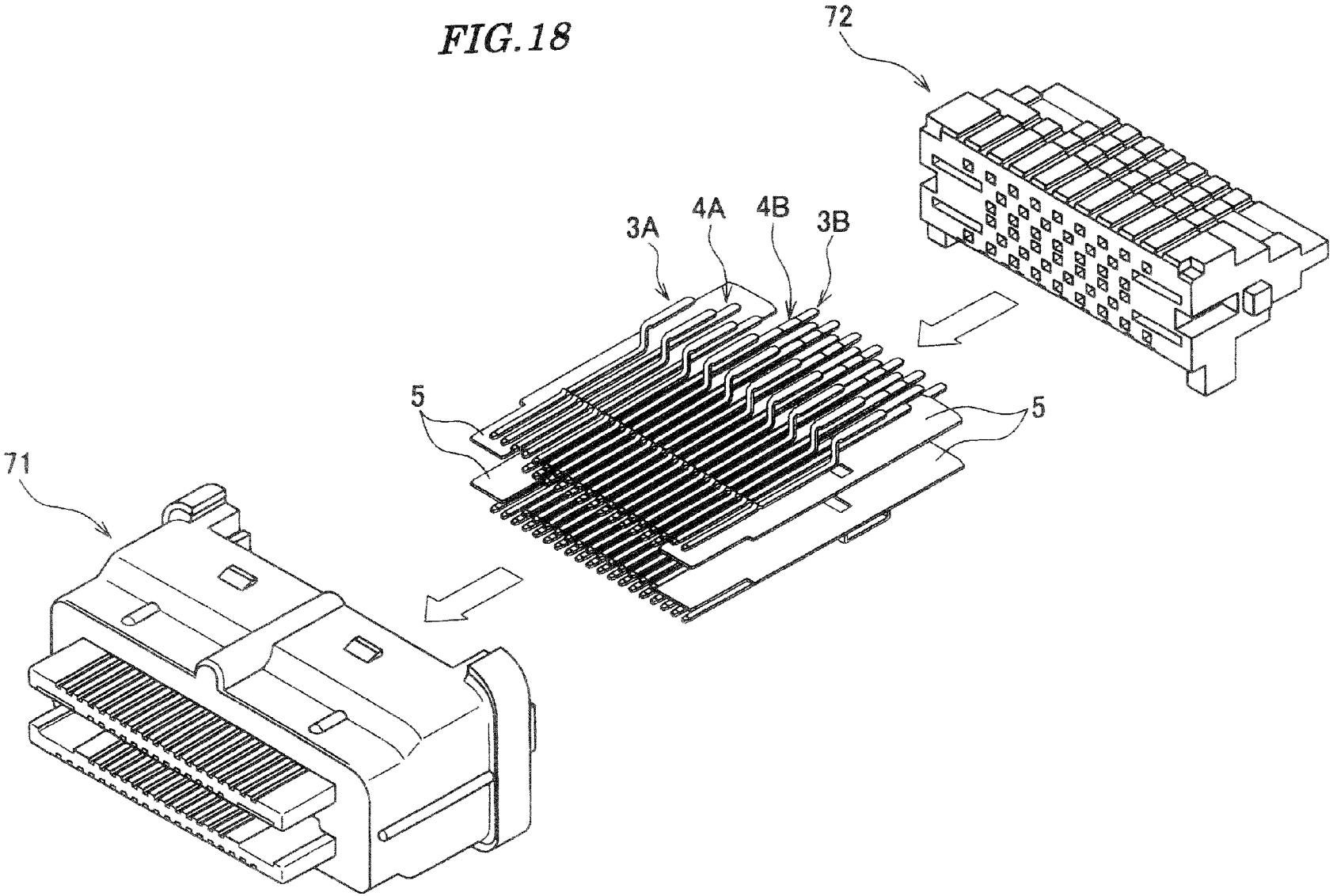
FIG. 18 is an exploded perspective view of the connector shown in FIG. 1 as taken obliquely from the front.
Figure 19:
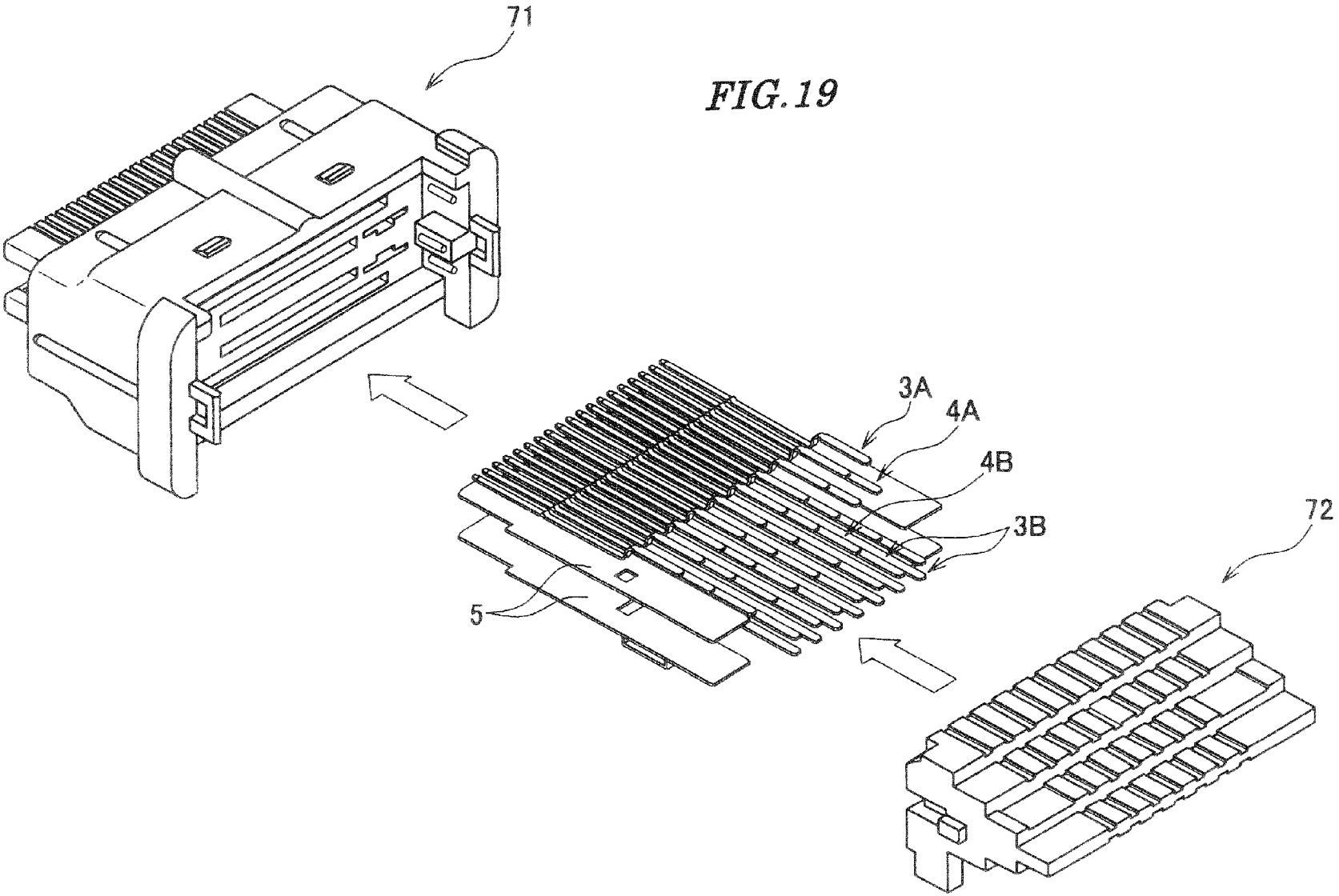
FIG. 19 is an exploded perspective view of the connector shown in FIG. 1 as taken obliquely from the rear.

The contacts 5 (see FIGS. 18 and 19) are the contacts for power-supply, and each have a large cross-section area so as to pass a large electric current.

As shown in FIGS. 1, 2, 4, and 6, the housing 7 is comprised of the front housing (first housing member) 71 and the rear housing (second housing member) 72.

The front housing 71 includes a front housing main body 711, two holding portions 712 and 713, and a pair of linking portions 714, and 714'.

As shown in FIGS. 4 and 6, the insertion holes 711*a*, 711*b*, 711*c*, and 711*d* are formed in a front portion of the front housing main body 711. The insertion holes 711*a* to 711*d* are arranged at respective four levels in the direction H of the height (as viewed in FIG. 3) of the housing. The insertion holes 711*a* are disposed at a top level, and are arranged at equally-spaced intervals along the contact arranging direction DC. The insertion holes 711*b* are disposed below the insertion holes 711*a*, and are arranged at equally-spaced intervals along the contact arranging direction DC. The insertion holes 711*c* are disposed below the insertion holes 711*b*, and are arranged at equally-spaced intervals along the contact arranging direction DC. The insertion holes 711*d* are disposed at a bottom level of the front housing main body 711, and are arranged at equally-spaced intervals along the contact arranging direction DC. The insertion holes 711*a* to 711*d* extend in the fitting/removing direction DF.

In the insertion holes 711*a*, there are inserted the respective front portions of the linking portions 33A and 43A of the contacts 3A and 4A in an alternating manner in the contact arranging direction DC. In the insertion holes 711*b*, there are inserted the respective front portions of the linking portions 33B and 43B of the contacts 3B and 4B in an alternating manner in the contact arranging direction DC. In the insertion holes 711*c*, there are inserted the front portions of the linking portions 33B and 43B of the contacts 3B and 4B in an alternating manner in the contact arranging direction DC. In the insertion holes 711*d*, there are arranged the front portions of the linking portions 33A and 43A of the contacts 3A and 4A in an alternating manner in the contact arranging direction DC.

The front housing main body 711 has four arrangement spaces 711*e*, 711*f*, 711*g*, and 711*h* (see FIG. 14) formed in a rear portion thereof. The four arrangement spaces 711*e* to 711*h* are arranged at four levels in the direction H (see FIG. 3) of the height of the housing 7. The arrangement space 711*e* is disposed at a top level, and extends in the contact arranging direction DC. The arrangement space 711*e* communicates with the insertion holes 711*a*. The arrangement space 711*e* faces an outer space rearward of the front housing main body 711. The arrangement space 711*f* is disposed below the arrangement space 711*e*, and extend in the contact arranging direction DC. The arrangement space 711*f* communicates with the insertion holes 711*b*. The arrangement space 711*f* faces the outer space rearward of the front housing main body 711. The arrangement space 711*g* is disposed below the arrangement space 711*f*, and extends in the contact arranging direction DC. The arrangement space 711*g* communicates with the insertion holes 711*c*. The arrangement space 711*g* faces the outer space rearward of the front housing main body 711. The arrangement space 711*h* is disposed below the arrangement space 711*g*, i.e., at the lowest one of the four levels of the four arrangement spaces 711*e* to 711*h*, and extends in the contact arranging direction DC. The arrangement space 711*h* communicates with the insertion holes 711*d*. The arrangement space 711*h* faces the outer space rearward of the front housing main body 711.

In the arrangement space 711*e*, there are inserted the rear portions of the linking portions 33A and 43A of the contacts 3A and 4A in an alternating manner in the contact arranging direction DC. In the arrangement space 711*f*, there are inserted the rear portions of the linking portions 33B and 43B of the contacts 3B and 4B in an alternating manner in the contact arranging direction DC. In the arrangement space 711*g*, there are inserted the rear portions of the linking portions 33B and 43B of the contacts 3B and 4B in an alternating manner in the contact arranging direction DC. In the arrangement space 711*h*, there are arranged the rear portions of the linking portions 33A and 43A of the contacts 3A and 4A in an alternating manner in the contact arranging direction DC.

The front housing main body 711 has insertion holes 711*i* formed at opposite lateral ends thereof (see FIGS. 14 and 15) The locations of the insertion holes 711*i* in the direction H of the height of the housing are substantially the same as that of the arrangement space 711*f*. Associated ones of the contacts 5 are inserted in the insertion holes 711*i* (see FIG. 19).

Figure 14:
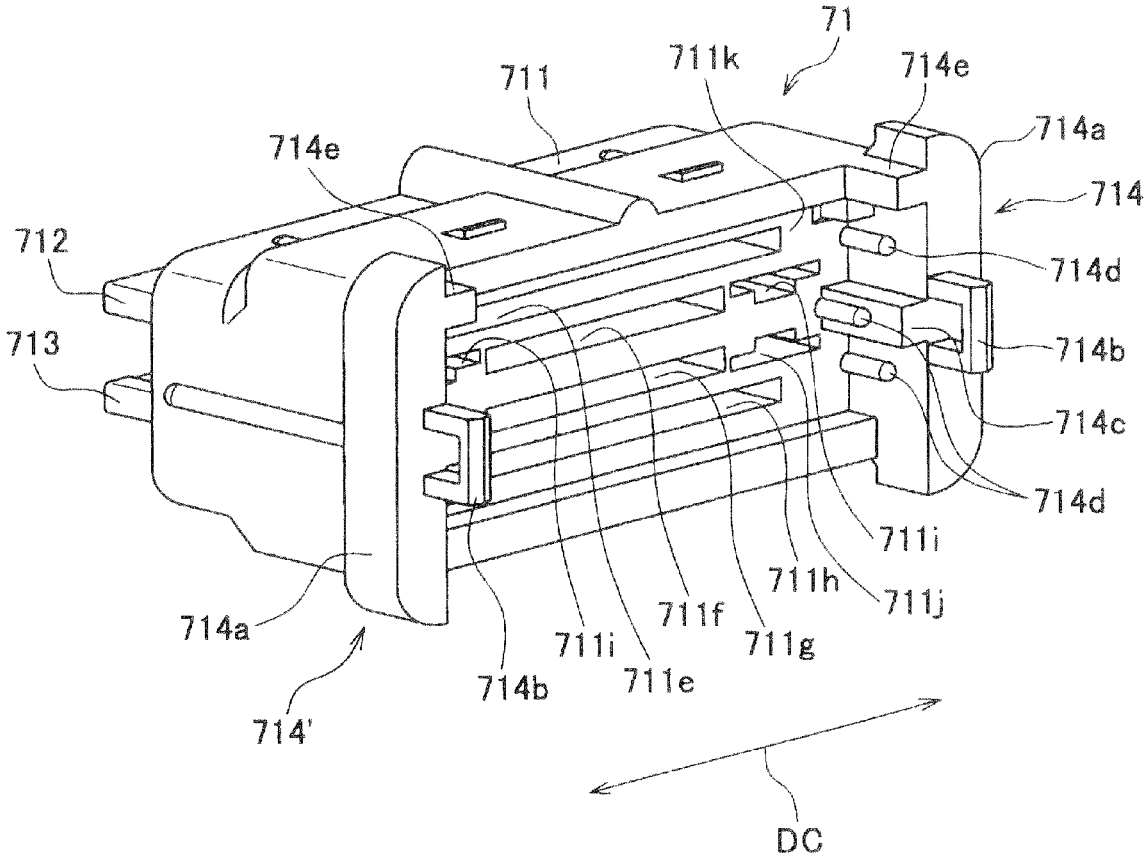
FIG. 14 is a perspective view of a front housing of the connector shown in FIG. 1.
Figure 15:
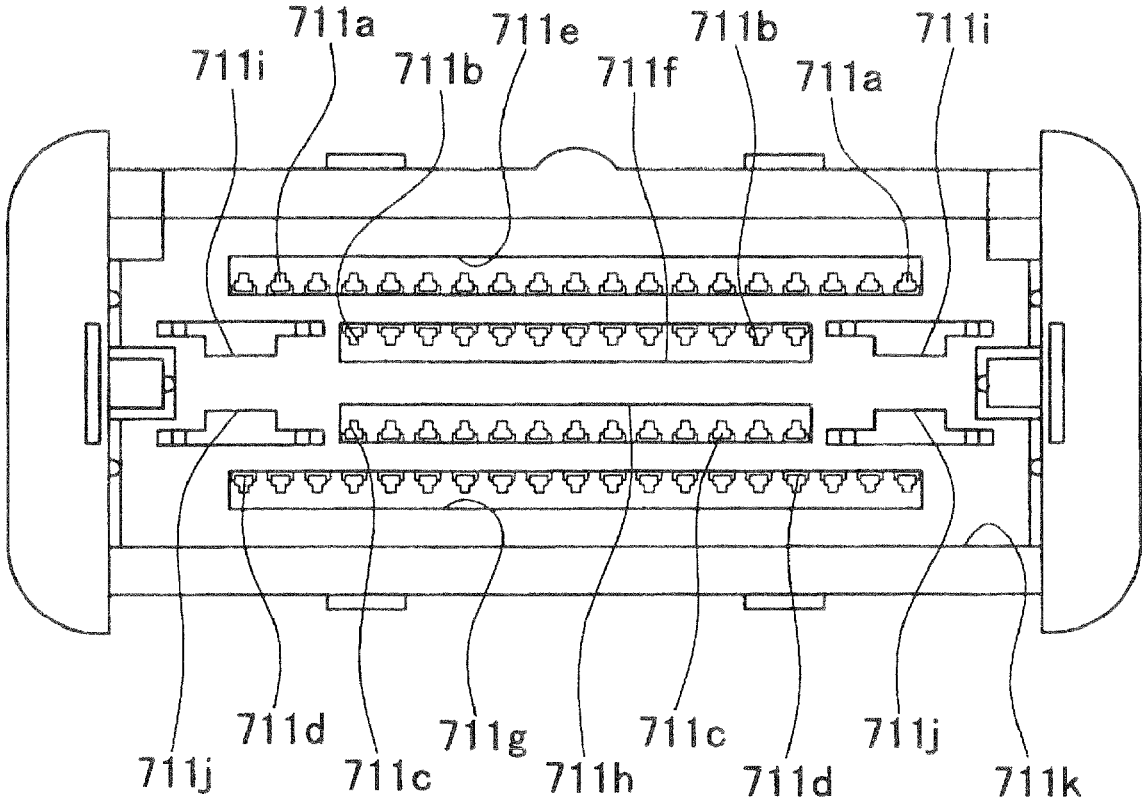
FIG. 15 is a rear view of the front housing shown in FIG. 14.

The front housing main body 711 has insertion holes 711*j* formed at the opposite lateral ends thereof (see FIGS. 14 and 15). The insertion holes 711*j* are disposed below the insertion holes 711*i*. The locations of the insertion holes 711*j* in the direction H of the height of the housing 7 are substantially same as that of the arrangement space 711*g*. Associated ones of the contacts 5 are inserted in the insertion holes 711*j* (see FIG. 19).

The front housing main body 711 has a recess 711*k* formed in a rear end thereof (see FIGS. 14 and 15). The recess 711*k* receives a front end of the rear housing 72.

The holding portion 712 is substantially plate-shaped, and is formed on the front end of the front housing main body 711 (see FIG. 1). The holding grooves 712*a* are formed in an upper surface of the holding portion 712 at equally-spaced intervals along the contact arranging direction DC (see FIG. 3). The holding grooves 712*a* extend in the fitting/removing direction DF, and communicate with the insertion holes 711*a*. The holding grooves 712*b* are formed in a lower surface of the holding portion 712 at equally-spaced intervals along the contact arranging direction DC (see FIG. 3). The holding grooves 712*b* extend in the fitting/removing direction DF, and communicate with the insertion holes 711*b*. In the holding grooves 712*a*, there are accommodated and positioned the contact portions 31A and 41A of the contacts 3A and 4A in an alternating manner in the contact arranging direction DC. In the holding grooves 712*b*, there are accommodated and positioned the contact portions 31B and 41B of the contacts 3B and 4B in an alternating manner in the contact arranging direction DC.

The holding portion 713 is substantially plate-shaped, and is formed on the front end of the front housing main body 711. The holding grooves 713*a* are formed in an upper surface of the holding portion 713 at equally-spaced intervals along the contact arranging direction DC (see FIG. 3) The holding grooves 713*a* extend in the fitting/removing direction DF, and communicate with the insertion holes 711*c*. The holding grooves 713*b* are formed in a lower surface of the holding portion 713 at equally-spaced intervals along the contact arranging direction DC (see FIG. 3). The holding grooves 713*b* extend in the fitting/removing direction DF, and communicate with the insertion holes 711*d*. In the holding grooves 713*a*, there are accommodated and positioned the contact portions 31B and 41B of the contacts 3B and 4B in an alternating manner in the contact arranging direction DC. In the holding grooves 713*b*, there are accommodated and positioned the contact portions 31A and 41A of the contacts 3A and 4A in an alternating manner in the contact arranging direction DC.

The pair of linking portions 714 and 714' are formed on the rear portion of the front housing main body 711, and are opposed to each other in the contact arranging direction DC (see FIG. 14).

The linking portion 714 includes a prismatic portion 714*a*, a locking portion (first locking portion) 714*b*, a key 714*c*, three protrusions 714*d*, and a pressing portion 714*e*. The prismatic portion 714*a* is continuous with the rear portion of the front housing main body 711. The locking portion 714*b* is substantially frame-shaped, and is formed on a rear portion of the prismatic portion 714*a*. The key 714*c* has a prismatic shape, extends in the fitting/removing direction DF, and is formed on a central portion of an inner surface of the prismatic portion 714*a*. The three protrusions 714*d* each having a substantially half-columnar shape are formed on the inner surfaces of the prismatic portion 714*a* and the key 714*c*, and extend in the fitting/removing direction DF. The pressing portion 714*e* has a prismatic shape, extends in the fitting/removing direction DF, and is formed at an upper part of the inner surface of the prismatic portion 714*a*.

The linking portion 714' includes a prismatic portion 714*a*, a locking portion 714*b*, a key 714*c*, three protrusions 714*d*, and a pressing portion 714*e*. Since these are the same as the prismatic portion 714*a*, the locking portion 714*b*, the key 714*c*, the three protrusions 714*d*, and the pressing portion 714*e* of the linking portion 714, a detailed description thereof is omitted.

The rear housing 72 is substantially staircase-shaped (see FIGS. 2 and 6), and includes a first step portion 721, a second step portion 722, a third step portion 723, a central step portion 724, a fifth step portion 725, a sixth step portion 726, and a seventh step portion 727.

The first step portion 721 is a top-level step (at a highest level in the direction H of the height of the housing 7) of the rear housing 72. The holding grooves 721*a* are formed in an upper surface of the first step portion 721 at equally-spaced intervals along the contact arranging direction DC (see FIG. 16). The holding grooves 721*a* extend in the fitting/removing direction DF. In the holding grooves 721*a*, there are accommodated and positioned the connection portions 32A of the contacts 3A (see FIG. 6).

The second step portion 722 is at a level immediately lower than that of the first step portion 721. The holding grooves 722*a* are formed in an upper surface of the second step portion 722 at equally-spaced intervals along the contact arranging direction DC. The holding grooves 722*a* extend in the fitting/removing direction DF. In the holding grooves 722a, there are accommodated and positioned the connection portions 42A of the contacts 4A (see FIG. 4).

The third step portion 723 is at a level immediately lower than that of the second step portion 722. The holding grooves 723*a* are formed in an upper surface of the third step portion 723 at equally-spaced intervals along the contact arranging direction DC. The holding grooves 723*a* extend in the fitting/removing direction DF. In the holding grooves 723*a*, there are accommodated and positioned the connection portions 42B of the contacts 4B (see FIG. 6).

The central step portion 724 is at a midpoint level in the direction of the height of the rear housing 72. The holding grooves 724*a* are formed in an upper surface of the central step portion 724 at equally-spaced intervals along the contact arranging direction DC, and the holding grooves 724*b* are formed in a lower surface thereof at equally-spaced intervals along the contact arranging direction DC. The holding grooves 724*a* and 724*b* extend in the fitting/removing direction DF. In the holding grooves 724*a* and 724*b*, there are accommodated and positioned the connection portions 32B of the contacts 3B (see FIG. 4).

The fifth step portion 725 is at a level immediately lower than of that of the central step portion 724. The holding grooves 725*a* are formed in a lower surface of the fifth step portion 725 at equally-spaced intervals along the contact arranging direction DC. The holding grooves 725*a* extend in the fitting/removing direction DF. In the holding grooves 725*a*, there are accommodated and positioned in the connection portions 42B of the contact 4B (see FIG. 6).

The sixth step portion 726 is located at a lower step of the fifth step portion 725 The holding grooves 726*a* are formed in a lower surface of the sixth step portion 726 at equally-spaced intervals along the contact arranging direction DC. The holding grooves 726*a* extend in the fitting/removing direction DF. In the holding grooves 726*a*, there are accommodated and positioned the connection portions 42A of the contacts 4A (see FIG. 4).

The seventh step portion 727 is at a level immediately lower than that of the sixth step portion 726. The holding grooves 727*a* are formed in a lower surface of the seventh step portion 727 at equally-spaced intervals along the contact arranging direction DC. The holding grooves 727*a* extend in the fitting/removing direction DF. In the holding grooves 727*a*, there are accommodated and positioned the connection portions 32A of the contacts 3A (see FIG. 6).

Figure 16:
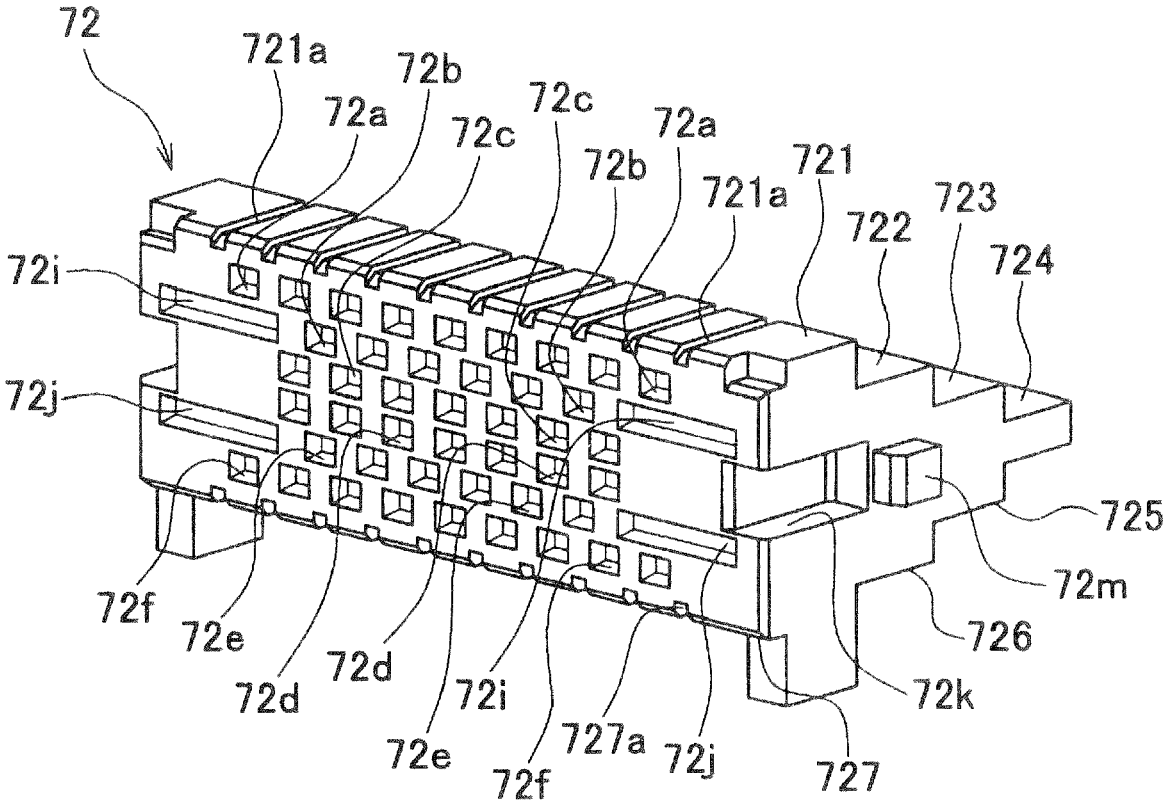
FIG. 16 is a perspective view of a rear housing of the connector shown in FIG. 1.
Figure 17:
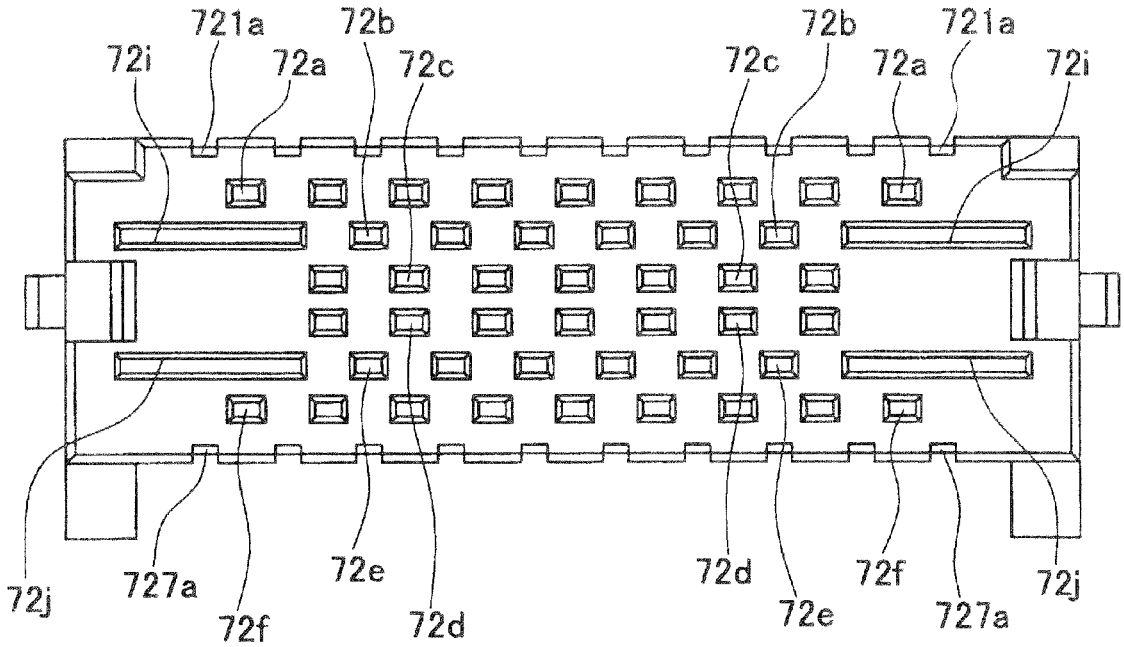
FIG. 17 is a front view of the rear housing shown in FIG. 16.

The insertion holes 72*a*, 72*b*, 72*c*, 72*d*, 72*e* and 72*f*, and insertion holes 72*i* and 72*j* open in a front end of the rear housing 72 (see FIG. 16). The insertion holes 72*a* to 72*j* are arranged in eight rows in the direction H of the height of the housing 7.

Of the insertion holes 72*a* to 72*j* formed through the rear housing, the insertion holes 72*a* are at a highest level, and are arranged at equally-spaced intervals along the contact arranging direction DC. The insertion holes 72*a* extend in the fitting/removing direction DF, and the holding grooves 722*a* and the insertion holes 711*a* extend as extensions thereof (see FIG. 4).

The insertion holes 72*b* are at a level immediately lower than that of the insertion holes 72*a*, and are arranged at equally-spaced intervals along the contact arranging direction DC. The insertion holes 72*b* extend in the fitting/removing direction DF, and the holding grooves 723*a* and the insertion holes 711*b* extend as extensions thereof (see FIG. 6).

The insertion holes 72*c* are at a level immediately lower than that of the insertion holes 72*b*, and are arranged at equally-spaced intervals along the contact arranging direction DC. The insertion holes 72*c* extend in the fitting/removing direction DF, and the holding grooves 724*a* extend as extensions thereof (see FIG. 4).

The insertion holes 72*d* are at a level immediately lower than that of the insertion holes 72*c*, and are arranged at equally-spaced intervals along the contact arranging direction DC. The insertion holes 72*d* extend in the fitting/removing direction DF, and the holding grooves 724*b* are extend as extensions thereof (see FIG. 4).

The insertion holes 72*e* are located at a level immediately lower than that of the insertion holes 72*d*, and are arranged at equally-spaced intervals along the contact arranging direction DC. The insertion holes 72*e* extend in the fitting/removing direction DF, and the holding grooves 725*a* and the insertion holes 711*c* extend as extensions thereof (see FIG. 6).

The insertion holes 72*f* are at a level immediately lower than that of the insertion holes 72*e*, and are arranged at equally-spaced intervals along the contact arranging direction DC. The insertion holes 72*f* extend in the fitting/removing direction DF, and the holding grooves 726*a* and the insertion holes 711*d* extend as extensions thereof (see FIG. 4).

The insertion holes 72*i* and 72*j* are formed through the opposite lateral end portions of the rear housing 72 (see FIG. 16). The insertion holes 72*i* are opposed to the insertion holes 711*i* of the front housing 71, and the insertion holes 72*j* are opposed to the insertion holes 711*j* of the front housing 71. The contacts 5 are inserted through the insertion holes 72*i* and 72*j*, respectively.

The rear housing 72 has key grooves 72*k* and protrusions (second locking portions) 72*m* formed in the opposite lateral ends thereof (see FIG. 16). The key grooves 72*k* extend in the fitting/removing direction DF, and guides the keys 714*c* of the front housing 71 in the fitting/removing direction DF when the front housing 71 and the rear housing 72 are fitted (assembled). When the front housing 71 and the rear housing 72 are fitted, the protrusions 72*m* are engaged with the locking portions 714*b*.

Figure 9:
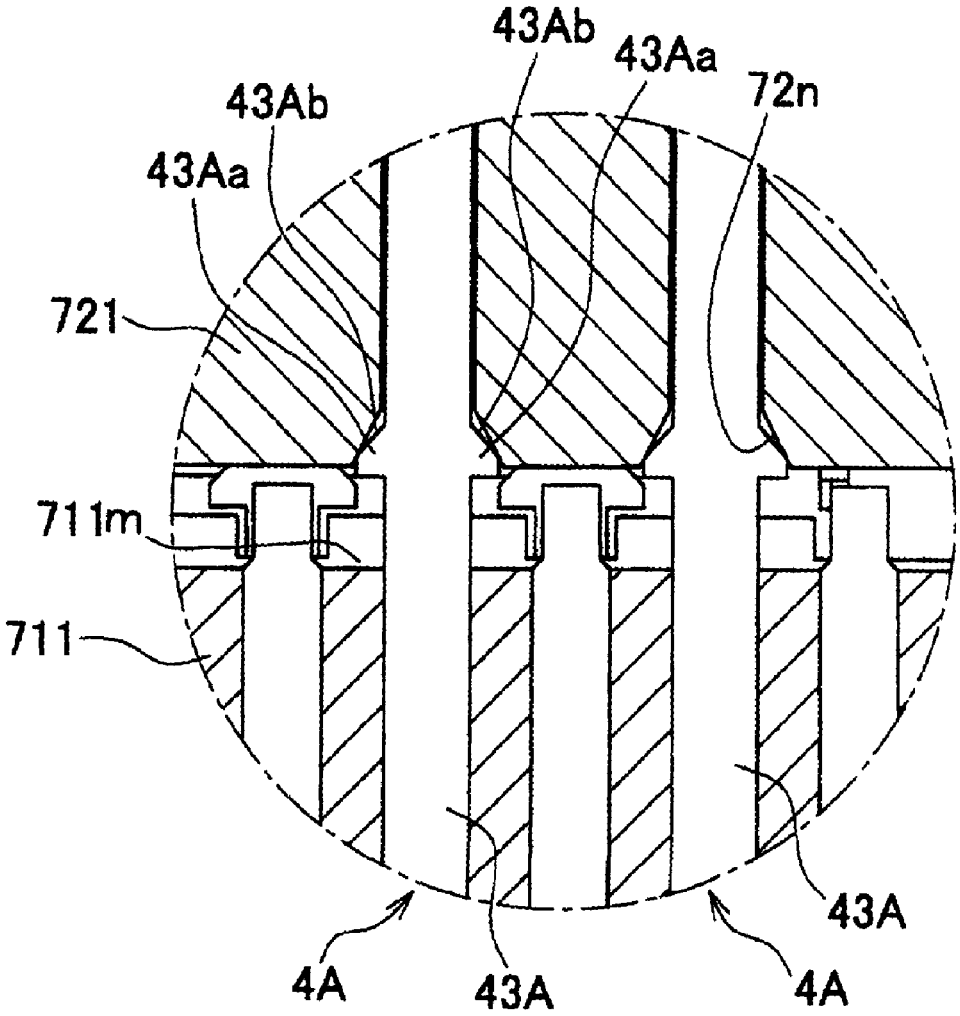
FIG. 9 is an enlarged view of part C in FIG. 8.

All of the insertion holes 72*a*, 72*b*, 72*c*, 72*d*, 72*e*, and 72*f* each have the rim of an opening thereof formed with the guiding surface 72*n* (see FIGS. 5 and 9). The guiding surface 72*n* forms a truncated pyramidal space in the opening of each of the insertion holes 72*a* to 72*f*.

Next, a description will be given of a procedure for assembling the connector 1.

First, the contacts 3A, 3B, 4A, 4B, and 5 arranged in one piece using a carrier, not shown, are inserted into the respective associated insertion holes 711*a*, 711*b*, 711*c*, 711*d*, 711*i*, and 711*j* of the front housing 71. At this time, the protruding pieces 33Ac of each contact 3A are press-fitted in the associated insertion hole 711*a* or 711*d*, the protruding pieces 33Bc of each contact 3B in the associated insertion hole 711*b* or 711*c*, the protruding pieces 43Ac of each contact 4A in the associated insertion hole 711*a* or 711*d*, and the protruding pieces 43Bc of each contact 4B in the associated insertion hole 711*b* or 711*c*. As a result, the contacts 3A, 3B, 4A, and 4B are fixed to the front housing.

Next, the carrier is removed from the contacts 3A, 3B, 4A, 4B, and 5.

Then, the connection portions 32A of the contacts 3A are inserted into the respective associated holding grooves 721*a* and 727*a* of the rear housing 72, and the connection portions 32B, 42A, and 42B of the contacts 3B, 4A, and 4B are inserted into the respective associated ones of the insertion holes 72*c*, 72*d*, 72*a*, 72*f*, 72*b*, and 72*e* of the rear housing 72. At this time, the guiding surfaces 72*n* guide the connection portions 32B, 42A, and 42B into the respective associated insertion holes 72*c*, 72*d*, 72*a*, 72*f*, 72*b*, and 72*e*.

Further, the rear ends of the contacts 5 are inserted in the respective associated insertion holes 72*i* and 72*j* of the rear housing 72.

Next, the front housing 71 and the rear housing 72 are fitted. At this time, the keys 714*c* of the front housing 71 are relatively guided into the key grooves 72*k* of the rear housing 72, and the front end of the rear housing 72 is fitted in the recess 711*k* of the front housing 71. Further, the inclined surfaces 43Ab and 43Bb of the protruding portions 43Aa and 43Ba of the contacts 4A and 4B are engaged with the guiding surfaces 72*n*, whereby the protruding portions 43Aa and 43Ba are positively placed at the predetermined locations (see FIG. 9).

When the front housing 71 and the rear housing 72 are completely fitted, the protrusions 72*m* of the rear housing 72 are engaged with the locking portions 714*b* (see FIG. 14) of the front housing 71, whereby the rear housing 72 is locked to the front housing 71. When the rear housing 72 is in a locked state to the front housing 71, the protrusions 714*d* of the front housing 71 are brought into pressure contact with side surfaces of the rear housing 72, and the pressing portions 714*e* of the front housing 71 press the upper surface of the first step portion 721 of the rear housing 72, whereby the rear housing 72 does not wobble.

When the rear housing 72 is locked to the front housing 71, the crank-shaped portions 33Aa and 33Ba of the contacts 3A and 3B, and the protruding portions 43Aa and 43Ba of the contacts 4A and 4B are placed between a rear surface 711*m* of the front housing 71 and the front surface 72*p* of the rear housing 72. At the same time, the crank-shaped portions 33Aa and 33Ba of the contacts 3A and 3B are brought into abutment with the front surface 72*p* of the rear housing 72, and the inclined surfaces 43Ab and 43Bb of the protruding portions 43Aa and 43Ba of the contacts 4A and 4B are brought into abutment with the guiding surfaces 72*n* of the rear housing 72 (see FIGS. 5, 7, and 9).

Therefore, even if pulling force acts on the connection portions 32A, 32B, 42A, and 42B of the contacts 3A, 3B, 4A, and 4B, as indicated by arrows in FIGS. 4 and 6, the contacts 3A, 3B, 4A, and 4B cannot be easily pulled out from the housing 7.

Further, the front housing 71 has the locking portions 714*b*, and the rear housing 72 has the protrusions 72*m* which are engaged with the locking portions 714*b*. Therefore, it is not necessary to have special components for maintaining a fitted state of the front housing 71 and the rear housing 72.

Further, since the guiding surfaces 72*n* are formed on the rear housing 72, it is possible to easily insert the connection portions 32B, 42A, and 42B of the contacts 3B, 4A, and 4B into the insertion holes 72*c*, 72*d*, 72*a*, 72*f*, 72*b*, and 72*e*, respectively, which makes it possible to easily assemble the connector 1.

Further, since each guiding surface 72*n* forms the truncated pyramidal space, it is easy to fill resin into a mold at the time of molding the rear housing 72. Further, since it is easy to fill resin into the mold, it is possible to reduce the arranging pitch of the contacts, thereby realizing a narrower pitch thereof.

In this embodiment, the contact portions are disposed in four rows in their vertical arrangement and the connection portions are disposed in eight rows in their vertical arrangement, by arrangement conversion (making the arrangement of contact portions different from that of connection portions) between the contact portions 31A, 31B, 41A and 41B, and the connection portions 32A, 32B, 42A and 42B of the contacts 3A, 3B, 4A, and 4B. This makes it possible to make the arranging pitch of the connection portions twice as large as the arranging pitch of the contact portions. As a result, it is possible to easily perform a soldering operation of the cable to the connection portions 32A, 32B, 42A, and 42B.

Although the crank-shaped portions 33Aa and 33Ba, or the protruding portions 43Aa and 43Ba are employed as the retaining portions of the contacts 3A, 3B, 4A, and 4B, the retaining portions are not limited to these, but they may be formed, for example, as T-shaped portions or cross-shaped portions.

Further, although the locking portions 714*b* are formed on the front housing 71 as the first locking portions, and the protrusions 72*m* are formed on the rear housing 72 as the second locking portions, this is not limitative, but in place of providing the first and second locking portions, bolts or glue may be used, for example, for maintaining a fitted state of the front housing 71 and the rear housing 72.

Although in the above-described embodiment, two types of contacts such as the crank-shaped contacts 3A and 3B, and the straight-shaped contacts 4A and 4B are used as contacts, there may be used, for example, only the crank-shaped contacts, only the straight-shaped contacts, or there or more types of contacts.

Further, although the housing 7 is formed by the front housing 71 and the rear housing 72, the housing may be formed by three or more housing members.

Although in this embodiment, the arrangement conversion is performed between the contact portions 31A, 31B, 41A, and 41B, and the connection portions 32A, 32B, 42A, and 42B of the contacts 3A, 3B, 4A, and 4B, whereby the contact portions and the connection portions are disposed in a four-row arrangement and an eight-row arrangement, respectively, the number of rows is not limited, but the contact portions may be disposed in one-row arrangement and the connection portions may be disposed in two-row arrangement, for example. Further, it is not necessarily required to perform arrangement conversion between the contact portions and the connection portions.

It is further understood by those skilled in the art that the foregoing are the preferred embodiments of the present invention, and that various changes and modification may be made thereto without departing from the spirit and scope thereof.

What is claimed is:

1. A connector comprising:

a plurality of contacts, each of which has a contact portion which is adapted to be brought into contact with one object to be connected, a connection portion which is adapted to be connected to another object to be connected, a linking portion which links said contact portion and said connection portion and is formed with a retaining portion, and a press-fitting portion; and a housing that holds said plurality of contacts by having said press-fitting portion of each of said of contacts press-fitted therein, said housing including a first housing member in which contact-side portions of said contacts are disposed, and a second housing member which is assembled with said first housing member and in which connection-side portions of said contacts are disposed, wherein said retaining portion is brought into abutment with said second housing member when said first and second housing members are assembled, and said first housing member has a surface facing said retaining portion.

2. A connector as claimed in claim 1, wherein said retaining portion is a crank-shaped portion which is formed by bending said linking portion of said contact into a crank shape.

3. A connector as claimed in claim 1, wherein said retaining portion is a protruding portion which is formed on said linking portion of said contact in a manner protruding in a width direction thereof.

4. A connector as claimed in claim 1, wherein said retaining portion of each of some of said plurality of contacts is a crank-shaped portion which is formed by bending said linking portion of said contact into a crank shape, and wherein said retaining portion of each of a remainder of said plurality of contacts is a protruding portion which is formed on said linking portion of said contact in a manner protruding in a width direction thereof.

5. A connector as claimed in claim 1, wherein said first housing member is formed with first locking portions, and wherein said second housing member is formed with second locking portions which are engaged with said first locking portions to thereby connect said second housing member to said first housing member.

6. A connector as claimed in claim 2, wherein said first housing member is formed with first locking portions, and wherein said second housing member is formed with second locking portions which are engaged with said first locking portions to thereby connect said second housing member to said first housing member.

7. A connector as claimed in claim 3, wherein said first housing member is formed with first locking portions, and wherein said second housing member is formed with second locking portions which are engaged with said first locking portions to thereby connect said second housing member to said first housing member.

* * * * *